US006723011B1

(12) United States Patent
Van Helvert et al.

(10) Patent No.: US 6,723,011 B1
(45) Date of Patent: Apr. 20, 2004

(54) SPORTS NET ASSEMBLY

(76) Inventors: Mike A. Van Helvert, 85 Roehampton Ave., St. Catherines Ont (CA), L2M 6B7; Bonnie Bowden, 85 Roehampton Ave., St. Catherines Ont (CA), L2M 6B7

( * ) Notice: Subject to any disclaimer, the term of this patent is extended or adjusted under 35 U.S.C. 154(b) by 5 days.

(21) Appl. No.: 10/159,046

(22) Filed: May 31, 2002

(51) Int. Cl.[7] ..... A63B 63/00
(52) U.S. Cl. ..... 473/478
(58) Field of Search ..... 473/478, 476, 473/477, 490; 24/442, FOR 212; 273/398–402

(56) References Cited

U.S. PATENT DOCUMENTS 4,247,099 A 1/1981 Pandak
4,579,344 A * 4/1986 Meggs ..... 473/478
D346,838 S 5/1994 Noval
5,405,132 A 4/1995 St. Onge
5,566,952 A * 10/1996 Mullin et al. ..... 273/400
5,827,139 A 10/1998 De Canio et al.
5,842,939 A * 12/1998 Pui et al. ..... 473/478
5,944,623 A 8/1999 Schlicting
6,113,507 A 9/2000 Padilla

* cited by examiner

*Primary Examiner*—Gregory Vidovich
*Assistant Examiner*—M. Chambers

(57) ABSTRACT

A sports net assembly for allowing users who play sports that require a goal to replace damaged netting without disassembling an entire net. The sports net assembly includes a sports net assembly for use in playing sports including a frame assembly. The frame assembly has at least one vertical support member. The frame assembly has a plurality of horizontal support members. A netting assembly has a mesh portion and an attachment portion. The attachment portion is removably couplable to the frame assembly. The mesh portion is for defining a sports goal wherein the netting assembly is coupled to the frame assembly. The netting assembly is for receiving a sporting implement such as a soccer ball.

6 Claims, 2 Drawing Sheets

SPORTS NET ASSEMBLY

BACKGROUND OF THE INVENTION

1. Field of the Invention

The present invention relates to sports goals and more particularly pertains to a new sports net assembly for allowing users who play sports that require a goal to replace damaged netting without disassembling an entire net.

2. Description of the Prior Art

The use of sports goals is known in the prior art. U.S. Pat. No. 6,113,507 describes a quick-attach sports net adapted for being quickly attached to and detached from a sports goal frame. Another type of sports goal is U.S. Pat. No. 5,827,139 describes a roller hockey net fastening device for attaching a roller hockey net to a desired location. U.S. Pat. No. 6,944,623 describes a combination quick connected disconnect basketball net and tote bag. U.S. Pat. No. 4,247,099 describes a tennis net center stay and measuring device for adjusting the height of the tennis net. U.S. Pat. No. 5,405,132 describes a transportable basketball net assembly for temporary use on a basketball rim. U.S. Pat. No. Des. 346,838 describes an ornamental design for a net barrier for sports training.

While these devices fulfill their respective, particular objectives and requirements, the need remains for a system that includes certain improved features such as easy and timesaving means of attaching a net to a goal.

SUMMARY OF THE INVENTION

The present invention meets the needs presented above by including an attachment member for facilitating quick and easy attachment to a sports goal.

Another object of the present invention is to provide a new sports net assembly that would allow a user to apply the present invention to a full assembled frame assembly.

Still another object of the present invention is to provide a new sports net assembly that would save the user time and effort when changing nets in sports goals.

To this end, the present invention generally comprises a sports net assembly for use in playing sports including a frame assembly. The frame assembly has at least one vertical support member. The frame assembly has a plurality of horizontal support members. A netting assembly has a mesh portion and an attachment portion. The attachment portion is removably couplable to the frame assembly. The mesh portion is for defining a sports goal wherein the netting assembly is coupled to the frame assembly. The netting assembly is for receiving a sporting implement such as a soccer ball.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
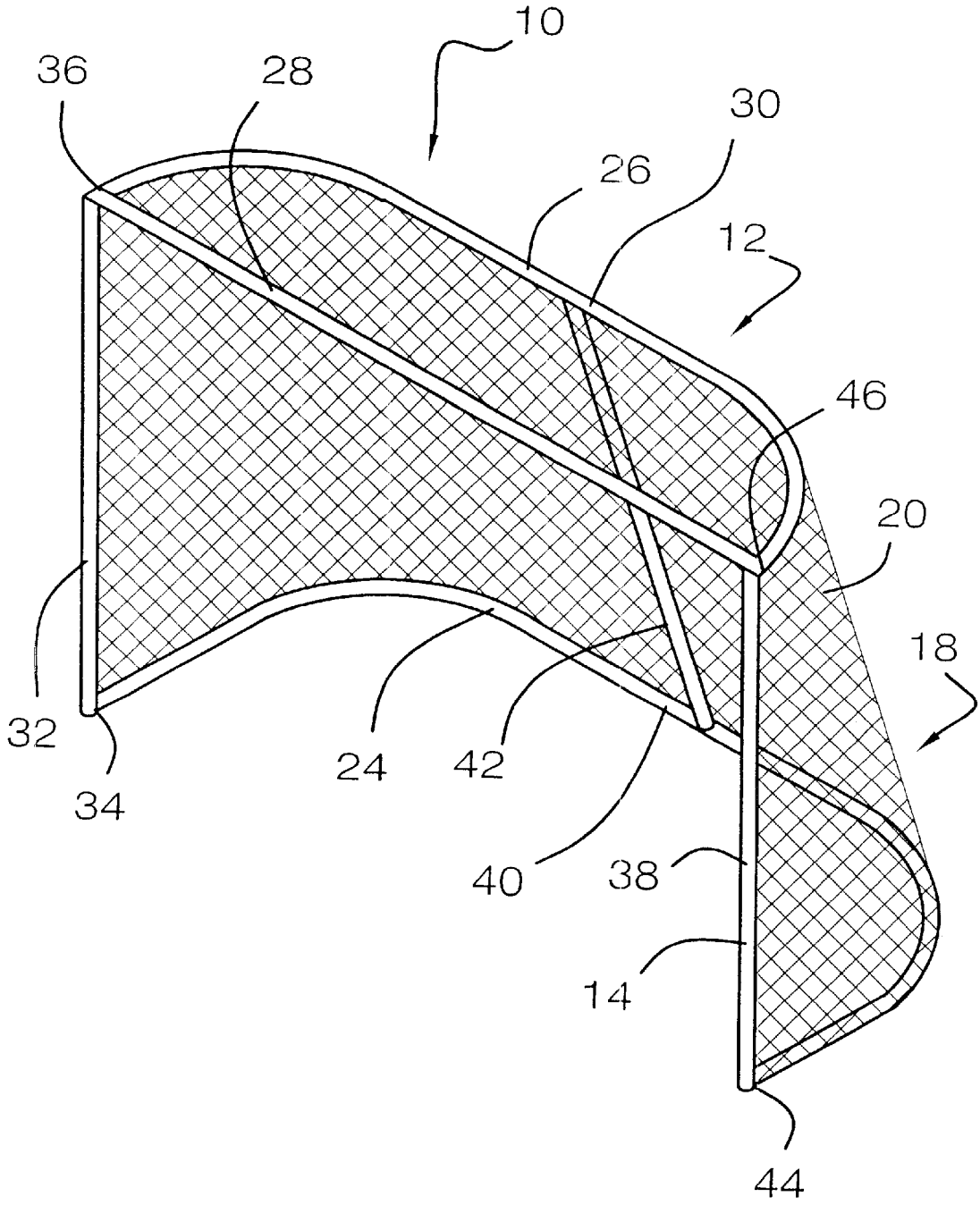
FIG. 1 is a perspective view of a new sports net assembly according to the present invention.
Figure 2:
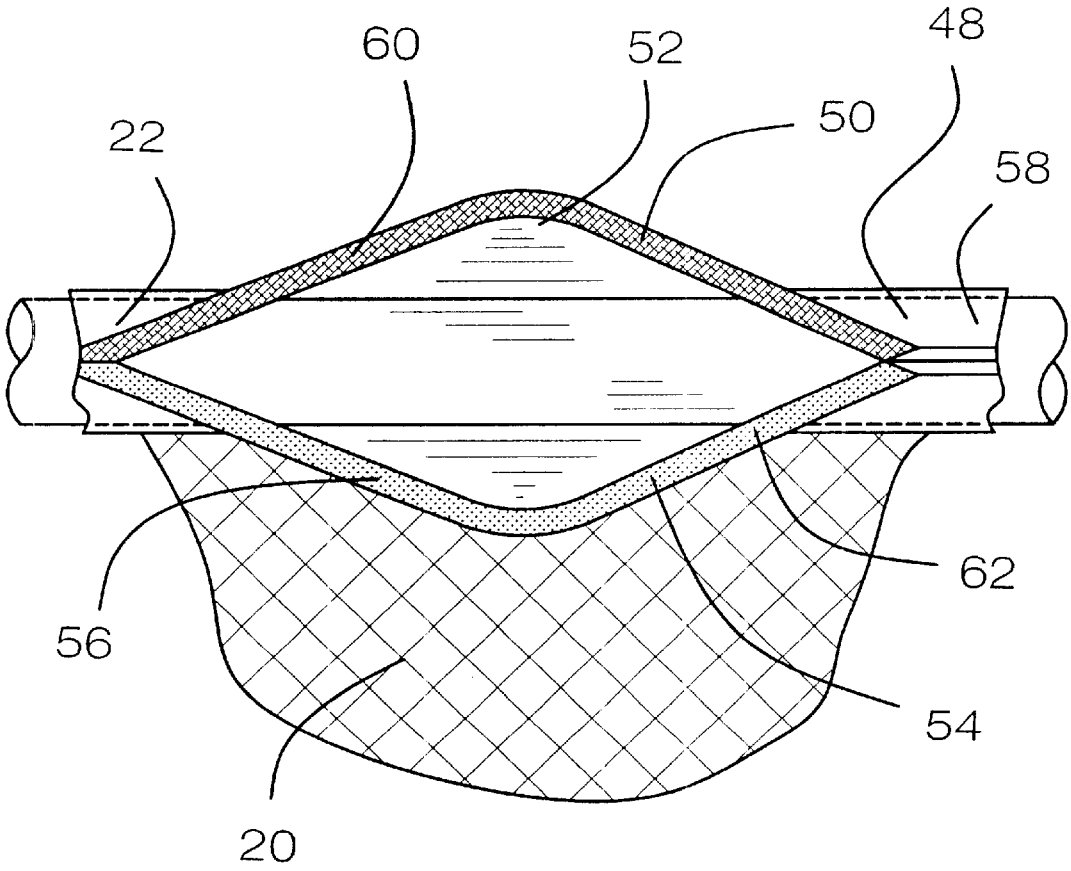
FIG. 2 is a front view of the present invention.

With reference now to the drawings, and in particular to FIGS. 1 through 2 thereof, a new sports net assembly embodying the principles and concepts of the present invention and generally designated by the reference numeral 10 will be described.

As best illustrated in FIGS. 1 through 2, the sports net assembly 10 generally comprises a frame assembly 12 that has at least one vertical support member 14. The frame assembly 12 has a plurality of horizontal support members 16. A netting assembly 18 has a mesh portion 20 and an attachment portion 22. The attachment portion 22 is removably couplable to the frame assembly 12. The mesh portion 20 is for defining a sports goal wherein the netting assembly 18 is coupled to the frame assembly 12. The netting assembly 18 is for receiving a sporting implement such as a soccer ball.

The frame assembly 12 is substantially u-shaped. The frame assembly 12 further includes an arcuate base member 24. The arcuate base member 24 is designed for resting on a horizontal support surface such as the ground. The top member 26 has a substantially D shape. The top member 26 is substantially narrower than the base member 24. The top member 26 and has an elongate portion 28 and an arcuate portion 30.

The frame assembly further includes a first vertical support member 32 positioned at a first end 34 of the base member 24 for supporting a first end 36 of a top member 26. A second vertical support member 38 is positioned about a medial portion 40 of the base member 24 for supporting the arcuate portion 30 of the top member 26. A third vertical support member 42 is positioned at a second end 44 of the base member 24 for supporting a second end 46 of the top member 26.

The attachment member 48 has opposing edges. A first fastening member 50 is coupled to a first one of the opposing edges 52. A second fastening member 54 is coupled to a second of the opposing edges 56. The first fastening member 50 is engagable to the second fastening member 54, whereby the attachment member 48 is couplable around the vertical 14 and the horizontal 16 support members of the frame assembly 12. The attachment member 48 has a padded portion 58. The attachment portion extends a full length of the frame assembly 12 for fastening the mesh portion 20 to the frame assembly 12 continuously along the full length of the frame assembly 12.

The first fastening member 50 is a first portion of a hook and loop fastener 60. The second fastening member 54 is a second portion of a hook and loop fastener 62 the first 60 and the second 62 portions of hook and loop fasteners is complimentary.

In use, a user would simply apply the attachment portion of the netting assembly by opening the ends of the attachment portion and slipping them over the appropriate portions of the frame assembly and closing the fastening members around the frame member securing the fastening members in place with the hook and loop fasteners.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sports net assembly for use in playing sports, comprising:

a frame assembly, said frame assembly having at least one vertical support member, said frame assembly having a plurality of horizontal support members; and a netting assembly having a mesh portion and a attachment portion, said attachment portion being removably couplable to said frame assembly, said mesh portion being for defining a sports goal wherein said netting assembly is coupled to said frame assembly, said netting assembly being for receiving a sporting implement such as a soccer ball;

said attachment member having opposing edges, a first fastening member being coupled to a first one of said opposing edges, a second fastening member coupled to a second of said opposing edges, said first fastening member being engagable to said second fastening member, whereby said attachment member is couplable around said vertical and said horizontal support members of said frame assembly;

said attachment member having a padded portion; and said attachment portion extends a full length of said frame assembly for fastening said mesh portion to said frame assembly continuously along the full length of said frame assembly.

2. The assembly of claim 1, wherein said frame assembly is substantially u-shaped, said frame assembly further includes an arcuate base member, said arcuate base member being adapted for resting on a horizontal support surface such as the ground.

3. The assembly of claim 1, wherein said top member having a substantially D shape, said top member being substantially narrower than said base member, said top member and having an elongate portion and an arcuate portion.

4. The assembly of claim 1, wherein said frame assembly further includes a first vertical support member positioned at a first end of said base member for supporting a first end of a top member, a second vertical support member positioned about a medial portion of said base member for supporting said arcuate portion of said top member, and a third vertical support member positioned at a second end of said base member for supporting a second end of said top member.

5. The assembly of claim 1, wherein said first fastening member is a first portion of a hook and loop fastener, said second fastening member is a second portion of a hook and loop fastener said first and said second portions of hook and loop fasteners being complimentary.

6. A sports net assembly for use in playing sports, comprising:

a frame assembly, said frame assembly having at least one vertical support member, said frame assembly having a plurality of horizontal support members; and a netting assembly having a mesh portion and a attachment portion, said attachment portion being removably couplable to said frame assembly, said mesh portion being for defining a sports goal wherein said netting assembly is coupled to said frame assembly, said netting assembly being for receiving a sporting implement such as a soccer ball;

wherein said frame assembly is substantially u-shaped, said frame assembly further includes an arcuate base member, said arcuate base member being adapted for resting on a horizontal support surface such as the ground;

wherein said top member having a substantially D shape, said top member being substantially narrower than said base member, said top member and having an elongate portion and a arcuate portion;

wherein said frame assembly further includes a first vertical support member positioned at a first end of said base member for supporting a first end of a top member, a second vertical support member positioned about a medial portion of said base member for supporting said arcuate portion of said top member, and a third vertical support member positioned at a second end of said base member for supporting a second end of said top member;

wherein said attachment member having opposing edges, a first fastening member being coupled to a first one of said opposing edges, a second fastening member coupled to a second of said opposing edges, said first fastening member being engagable to said second fastening member, whereby said attachment member is couplable around said vertical and said horizontal support members of said frame assembly;

wherein said first fastening member is a first portion of a hook and loop fastener, said second fastening member is a second portion of a hook and loop fastener said first and said second portions of hook and loop fasteners being complimentary;

wherein said attachment member having a padded portion; and wherein said attachment portion extends a full length of said frame assembly for fastening said mesh portion to said frame assembly continuously along the full length of said frame assembly.

* * * * *